US007000961B2

(12) United States Patent
Gorman

(10) Patent No.: US 7,000,961 B2
(45) Date of Patent: Feb. 21, 2006

(54) IMPLEMENT FOR COLLECTING ANIMAL FAECES

(76) Inventor: James Eoin Gorman, 21 Tullybrannigan Road, New Castle, BT33 OHR, County Down (IE)

( * ) Notice: Subject to any disclaimer, the term of this patent is extended or adjusted under 35 U.S.C. 154(b) by 302 days.

(21) Appl. No.: 10/311,532

(22) PCT Filed: Jun. 14, 2001

(86) PCT No.: PCT/GB01/02603

§ 371 (c)(1),
(2), (4) Date: Feb. 19, 2003

(87) PCT Pub. No.: WO01/95705

PCT Pub. Date: Dec. 20, 2001

(65) Prior Publication Data

US 2003/0155784 A1 Aug. 21, 2003

(30) Foreign Application Priority Data

Jun. 14, 2000 (GB) ..... 0014491

(51) Int. Cl.
*A01K 29/00* (2006.01)
*E01H 1/12* (2006.01)

(52) U.S. Cl. ..... 294/1.4

(58) Field of Classification Search ..... 294/1.3, 294/1.4, 50.6–50.9, 68.22; 15/257.1, 257.3
See application file for complete search history.

(56) References Cited

U.S. PATENT DOCUMENTS

| | | | | |
|---|---|---|---|---|
| 985,596 | A * | 2/1911 | Jacobs | 111/101 |
| 3,740,086 | A * | 6/1973 | Rossitto | 294/1.4 |
| 3,802,728 | A | 4/1974 | Giacopelli | |
| 3,817,194 | A | 6/1974 | Seebald | |
| 3,819,220 | A | 6/1974 | Bredt | |
| 4,179,145 | A | 12/1979 | Shinsako | |
| 4,253,691 | A | 3/1981 | Liu | |
| 4,286,816 | A | 9/1981 | Tobias | |
| 4,422,681 | A * | 12/1983 | Laroche | 294/1.4 |

FOREIGN PATENT DOCUMENTS

| | | |
|---|---|---|
| DE | 296 15 725 U 1 | 3/1997 |
| FR | 0 561 093 A 1 | 9/1993 |

* cited by examiner

*Primary Examiner*—Dean J. Kramer
(74) *Attorney, Agent, or Firm*—Ronald E. Greigg

(57) ABSTRACT

An implement for collecting animal faeces comprises a baton in which the lower portion is tubular whose lower end is enlarged and has an open end whereat a disposable cartridge is internally fitted. The cartridge has a tubular body with a ring member in which is defined an opening or aperture in communication with a container located within the baton. A handle movable relative to the baton is provided to eject the cartridge from the baton for disposal after use. The cartridge has a containment ring positioned externally of the baton (10). The ring member is movable relative to the containment ring during a faecal matter lifting operation.

20 Claims, 3 Drawing Sheets

IMPLEMENT FOR COLLECTING ANIMAL FAECES

CROSS-REFERENCE TO RELATED APPLICATIONS

This application is a 35 USC 371 application of PCT/GB 01/02603 filed on Jun. 14, 2001.

BACKGROUND OF THE INVENTION

Field of the Invention

This invention relates to an implement for collecting animal faeces particularly when walking a dog or other animal, or after other animals have excreted in a garden or in a play area.

SUMMARY OF THE INVENTION

The present invention is an implement for collecting animal faeces comprising a baton in which the lower portion at least is tubular and towards the lower end is enlarged and having an open end whereat a disposable cartridge is internally fitted, the cartridge having collecting means with an opening or aperture in communication with a container located within the baton, and means to eject the cartridge from the baton for disposal after use, the cartridge having an containment ring positioned externally of the baton and the collection means having a ring member in which the opening or aperture is defined the ring member being movable relative to the containment ring during a faecal matter lifting operation.

Preferably, the collecting means comprises a tubular body at one end across which the ring member is provided, the other end having the container, e. g. a bag made of plastics material, and catch means to be engaged by gripping means provided at the lower end of an internally movable sub-assembly. The sub-assembly desirably comprises a frusto-conical body having an open lower end with the gripping means and a closed upper end connected by a rod to a handle at the top of the baton and mounted for movement relative to the baton. Towards the top of the baton, two metrically opposite guideways are beneficially provided having a first elongate part parallel to the longitudinal axis of the baton, a second transverse part at the top of the first part and a third shorter elongate part parallel to the first elongate part and extending upwardly. The inside of the handle has preferably two diametrically inwardly extending guides to track the guideways. A detent or protrusion is beneficially provided in the second transverse part to prevent accidental movement between the first and third parts. The handle is desirably spring-biased away from the baton and the length of the first elongate part of the guideway determines the extent of movement of the ring member between a position at the top of the containment ring and at its bottom, i. e. the extent of its lifting movement. Rotational movement of the handle desirably causes the guides to move across into the second transverse part of the respective guideway past the detent or protrusion and into the third part, the handle moving under spring-biasing to cause the gripping means to separate from the catch means and the cartridge to be ejected, the limit of the handle movement determined by the length of the third part of the guideway.

Preferably also, the containment ring has an inwardly-directed lip at its upper end and the tubular body below the ring member has an outwardly-directed flange to engage the lip. The containment ring desirable has a friction-fit shoulder at its upper end to engage with the bottom end of the tubular wall of the baton. This serves to prevent upward movement of the cartridge as the cartridge is about to be ejected by upward movement of the sub-assembly. A cap is desirably provided to be a friction-fit over the bottom end and sides of the containment ring.

Preferably further, the ring member has a series of radial fingers extending inwardly from its periphery. Eight fingers are desirably in the series, four fingers being longer than the other four fingers, the longer fingers alternating with the others. The inner ends of all fingers each beneficially have a bulbous end.

BRIEF DESCRIPTION OF THE DRAWINGS

An embodiment of the present invention will now be described by way of example, with reference to the accompanying drawing, in which:—

DESCRIPTION OF THE PREFERRED EMBODIMENTS

Figure 1:
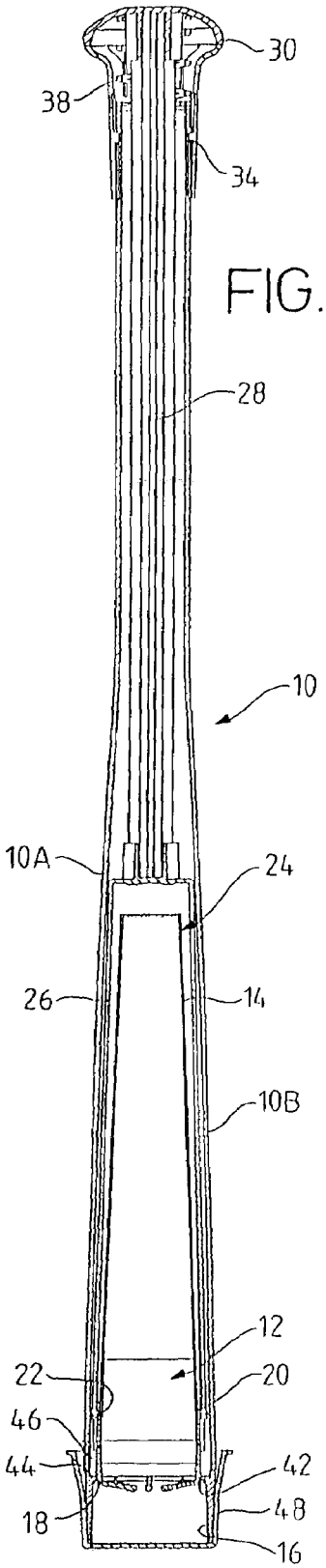
FIG. 1 shows a cross-sectional view of an implement according to the present invention, showing a baton 10 with a cap in position over a containment ring.
Figure 3:
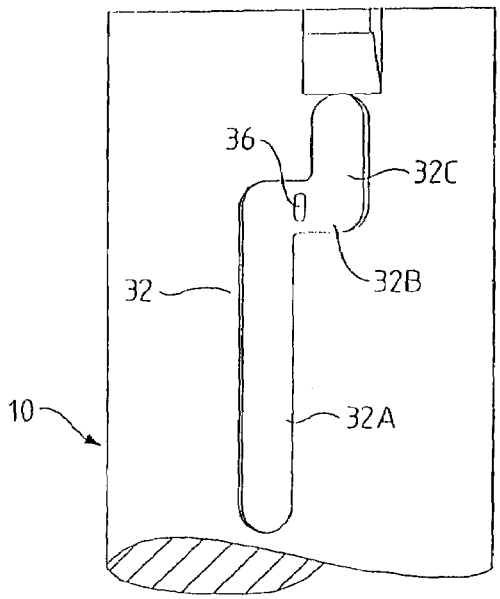
FIG. 3 shows an enlarged view of a guideway provided at the upper end of the baton 10.
Figure 4:
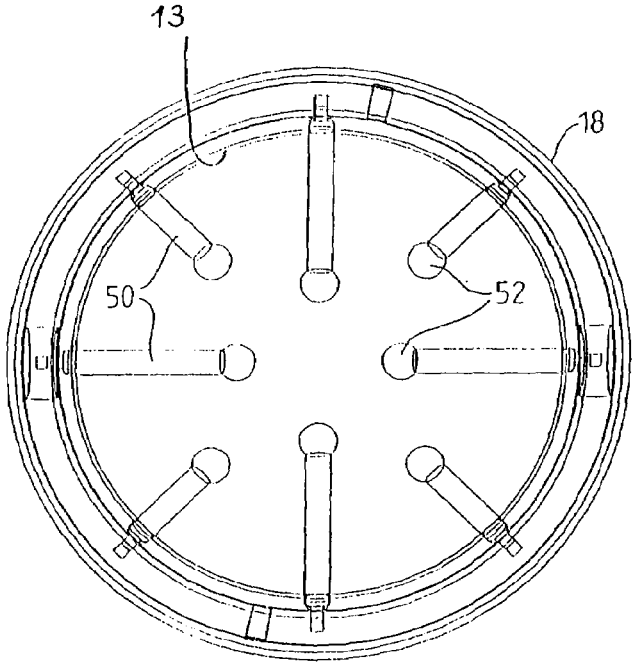
FIG. 4 shows an enlarged view of the ring member.
Figure 2B:
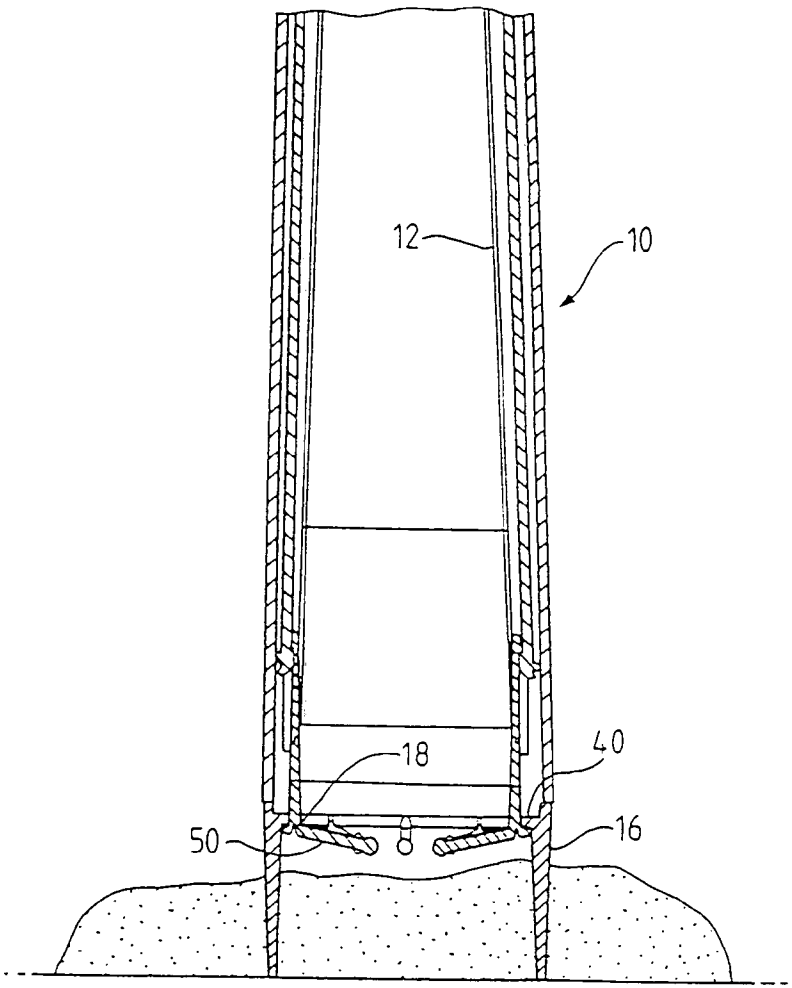
FIGS. 2A, 2B, 2C and 2D show in cross-sectional views of the lower part of the baton a sequence of actions involved in the use of the baton, the containment ring having the cap thereover, and with the cap removed, the containment ring pushed into faecal matter to be lifted, a ring member pushed into the faecal matter, and the baton lifted out of the faecal matter with the faecal matter held on the other side of the ring member respectively.
Figure 2A:
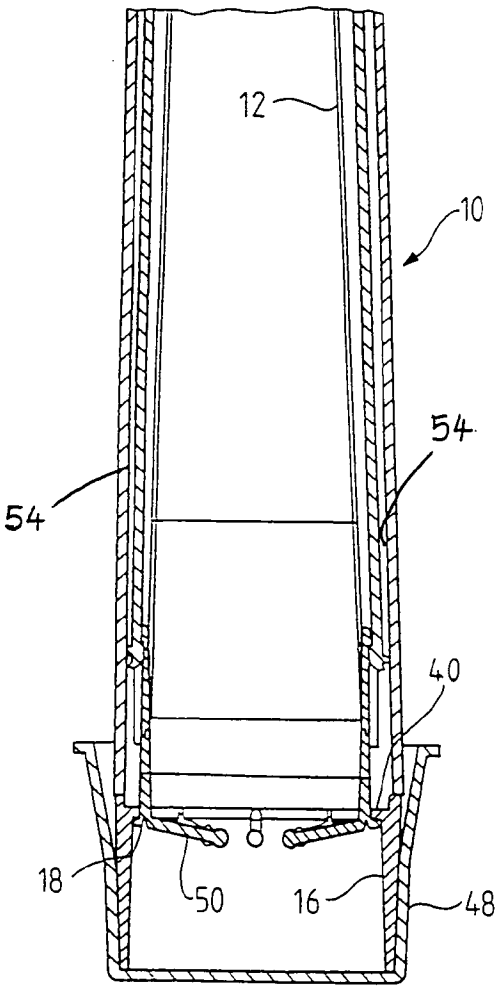
Figure 2D:
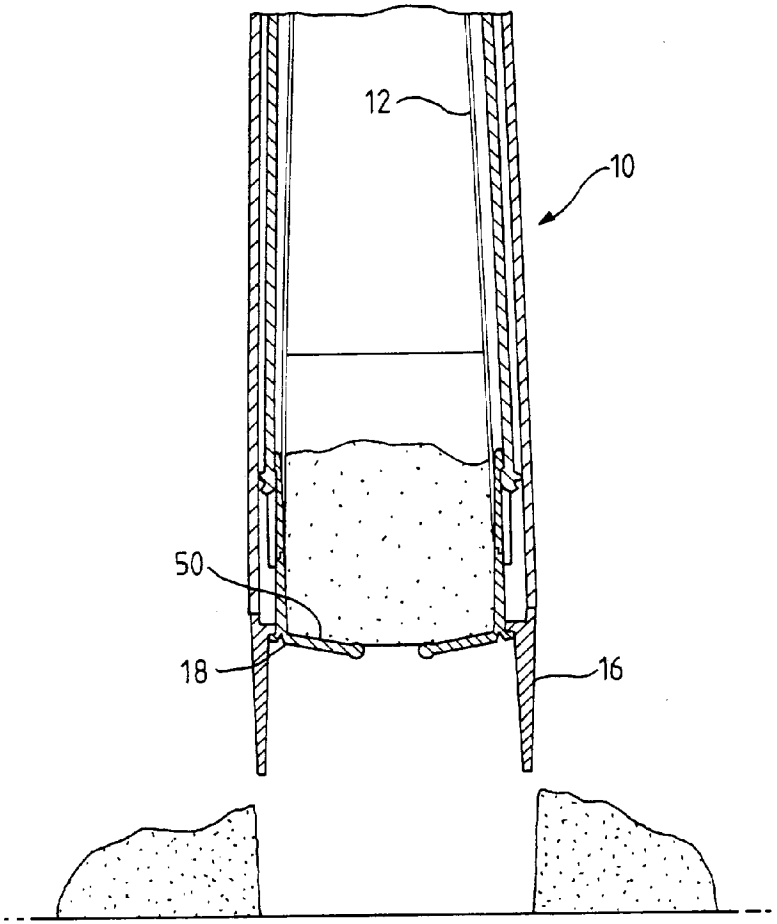
Figure 2C:
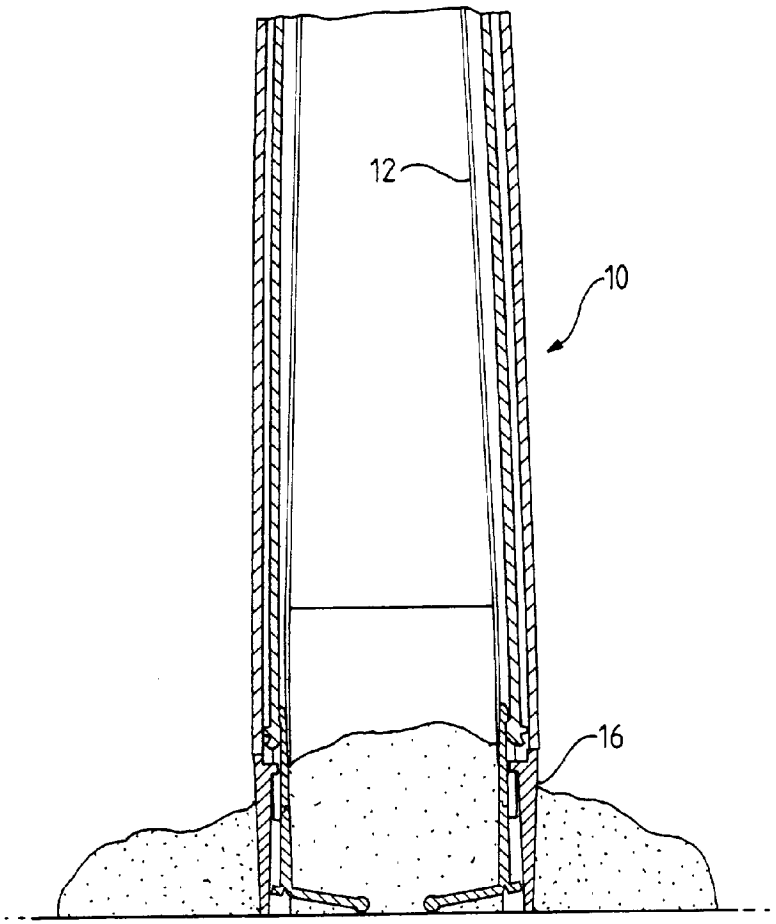

Referring to the drawings, an implement for collecting animal faeces comprises a baton 10 in which at least the lower portion 10A is tubular and towards its lower end 1 OB is enlarged and has an open end whereat a disposable cartridge 12 is internally fitted. The cartridge 12 has collecting means with an opening or aperture 13 (FIG. 4) in communication with a container 14 located within the baton 10. Means to eject the cartridge 12 from the baton 10 for disposal after use is provided. The cartridge 12 has a containment ring 16 positioned externally of the baton 10. The collection means having a ring member 18 in which is defined the aperture 13. The ring member 18 is movable relative to the containment ring 16 during a faecal matter lifting operation.

The collecting means comprises a tubular body 20 at one end across which the ring member 18 is provided, the other end having the container 14, e. g. a bag of plastics material, and catch means in the form of a continuous or part continuous peripheral rib 22 to be engaged by gripping means provided at the lower end of an internally movable sub-assembly 24. The sub-assembly 24 comprises a frusto-conical body 26 having an open lower end with the gripping means and a closed upper end connected by a rod 28 to a handle 30 at the top of the baton 10 and mounted for movement relative to the baton 10. Towards the top of the baton 10, two diametrically opposite guideways 32 are provided having a first elongate part 32A parallel to the longitudinal axis of the baton 10, a second transverse part 32B at the top of the first part 32A and a third shorter elongate part 32C parallel to the first elongate part 32A and extending upwardly. The inside of the handle 30 has two diametrically inwardly extending guides 34 to track the guideways 32. A detent or protrusion 36 is provided in the second transverse part 32B to prevent accidental movement between the first and third parts 32A, 32C. The handle 30 is spring-biased by a tension spring 38 away from the baton 10 and the length of the first elongate part 32A of the guideways 32 determines the extent of movement of the ring member 18 between a position at the top of the containment ring 16 and at its bottom, i. e. the extent of its lifting movement. Rotational movement of the handle 30 causes the guides 34 to move across into the second transverse part 32B of the respective guideway 32 past the detent or protrusion 36 and into the third part 32C, the handle 30 moving under the spring-biasing to cause the gripping means to separate from the catch means and the cartridge 12 to be ejected, the limit of the handle movement determined by the length of the third part 32C of the guideway 32.

The containment ring 16 has an inwardly-directed lip 40 at its upper end and the tubular body 20 below the ring member 18 has an outwardly-directed flange 42 to engage the lip 40. The containment ring 16 has a friction-fit shoulder 44 at its upper end to engage with the bottom end 46 of the tubular wall of the baton 10. This serves to prevent upward movement of the cartridge 12 as the cartridge 12 is about to be ejected by upward movement of the sub-assembly 24. A cap 48 is provided to be a friction-fit over the bottom end and sides of the containment ring.

The ring member 18 has a series of radial fingers 50 extending inwardly from its periphery. Eight fingers 50 are in the series, four fingers being longer than the other four fingers, the longer fingers alternating with the others. The inner ends of all fingers each have a bulbous end 52.

The gripping means is a continuous or dis-continuous groove 54 provided internally of the cone 26, the rib 22 and groove 54 being matable.

In use, with the cap 48 removed, the containment ring 16 is pushed into the faecal matter to be lifted and is advantageous since it prevents the faecal matter trapped therein from spreading outwardly as the ring member 18 is pressed down into and through the faecal matter and ensuring the trapped faecal matter is all held by the ring member 18. The baton 10 is then used again to lift another portion of the faecal matter, the second portion of the faecal matter pushing the first portion upwardly into the container. The baton 10 is used in this way as often as is required to lift all the faecal matter at the one location and at a series of locations, if necessary, during an exercising walk with the pet animal, generally a dog.

The handle may be constructed to have a closable cavity for carrying a disinfectant, a self-defensive offensive liquid, for example mace, or accommodation for a torch or an alarm mechanism. Where the cavity holds a liquid, a spray nozzle may be associated with dispersement of the liquid.

Variations and modifications can be made without departing from the scope of the invention described above and as claimed hereinafter.

I claim:

1. An implement for collecting animal faeces comprising a baton in which a lower end portion at least is tubular with at least a portion towards the lower end being enlarged and having an open end whereat a disposable cartridge is internally fitted, the cartridge having collecting means for lifting faecal matter with an aperture in communication with a container located within the baton, and means to eject the cartridge from the baton for disposal after use, the cartridge having a containment ring positioned externally of the baton for trapping faecal matter to be lifted by said collecting means and said collecting means having a ring member in which the aperture is defined, the ring member being movable relative to the containment ring during a faecal matter lifting operation.

2. An implement for collecting animal faeces as claimed in claim 1, wherein the collecting means comprises a tubular body at one end across which the ring member is provided, the other end having the container and catch means to be engaged by gripping means provided at the lower end of an internally movable sub-assembly.

3. An implement for collecting animal faeces as claimed in claim 2, wherein the sub-assembly comprises a frusto-conical body having an open lower end with the gripping means and a closed upper end connected by a rod to a handle at the top of the baton and mounted for movement relative to the baton.

4. An implement for collecting animal faeces as claimed in claim 3, wherein towards the top of the baton, two diametrically opposite guideways are provided having a first elongate part parallel to the longitudinal axis of the baton, a second transverse part at the top of the first part and a third shorter elongate part parallel to the first elongate part and extending upwardly.

5. An implement for collecting animal faeces as claimed in claim 4, wherein the inside of the handle has two diametrically inwardly extending guides to track the guideways.

6. An implement for collecting animal faeces as claimed in claim 5, wherein a detent or protrusion is provided in the second transverse part to prevent accidental movement between the first and third parts.

7. An implement for collecting animal faeces as claimed in claim 6, wherein the handle is spring-biased away from the baton and the length of the first elongate part of the guideway determines the extent of movement of the ring member between a position at the top of the containment ring and at its bottom.

8. An implement for collecting animal faeces as claimed in claim 6, wherein rotational movement of the handle causes the guides to move across into the second transverse part of the respective guideway past the detent or protrusion and into the third part, the handle moving under spring-biasing to cause the gripping means to separate from the catch means and the cartridge to be ejected, the limit of the handle movement determined by the length of the third part of the guideway.

9. An implement for collecting animal faeces as claimed in claim 5, wherein the handle is spring-biased away from the baton and the length of the first elongate part of the guideway determines the extent of movement of the ring member between a position at the top of the containment ring and at its bottom.

10. An implement for collecting animal faeces as claimed in claim 4, wherein the handle is spring-biased away from the baton and the length of the first elongate part of the guideway determines the extent of movement of the ring member between a position at the top of the containment ring and at its bottom.

11. An implement for collecting animal faeces as claimed in claim 2, wherein towards the top of the baton, two diametrically opposite guideways are provided having a first elongate part parallel to the longitudinal axis of the baton, a second transverse part at the top of the first part and a third shorter elongate part parallel to the first elongate part and extending upwardly.

12. An implement for collecting animal faeces as claimed in claim 2, wherein the containment ring has an inwardly-directed lip at its upper end and the tubular body below the ring member has an outwardly-directed flange to engage the lip.

13. An implement for collecting animal faeces as claimed in claim 1, wherein towards the top of the baton, two diametrically opposite guideways are provided having a first elongate part parallel to the longitudinal axis of the baton, a second transverse part at the top of the first part and a third shorter elongate part parallel to the first elongate part and extending upwardly.

14. An implement for collecting animal faeces as claimed in claim 13, wherein a detent or protrusion is provided in the second transverse part to prevent accidental movement between the first and third parts.

15. An implement for collecting animal faeces as claimed in claim 1, wherein the containment ring has a friction-fit shoulder at its upper end to engage with the bottom end of the tubular wall of the baton.

16. An implement for collecting animal faeces as claimed in claim 1, wherein a cap is provided to be a friction-fit over the bottom end and sides of the containment ring.

17. An implement for collecting animal faeces as claimed in claim 1, wherein the ring member has a series of radial fingers extending inwardly from its periphery.

18. An implement for collecting animal faeces as claimed in claim 17, wherein eight fingers are in the series, four fingers being longer than the other four fingers, the longer fingers alternating with the others.

19. An implement for collecting animal faeces as claimed in claim 18, wherein the inner ends of all fingers each beneficially have a bulbous end.

20. An implement for collecting animal faeces as claimed in claim 17, wherein the inner ends of all fingers each beneficially have a bulbous end.

* * * * *